United States Patent [19]

Kane

[11] Patent Number: 4,816,790

[45] Date of Patent: Mar. 28, 1989

[54] LINEAR MICROWAVE ATTENUATOR

[75] Inventor: Robert C. Kane, Woodstock, Ill.

[73] Assignee: Motorola, Inc., Schaumburg, Ill.

[21] Appl. No.: 85,445

[22] Filed: Aug. 13, 1987

[51] Int. Cl.[4] ..... H01P 1/22

[52] U.S. Cl. ..... 333/81 B; 333/81 R; 333/248

[58] Field of Search ..... 333/81 B, 81 R, 81 A, 333/22 R, 248

[56] References Cited

U.S. PATENT DOCUMENTS

| | | | |
|---|---|---|---|
| 2,531,194 | 11/1950 | Bowen | 333/81 B |
| 2,603,710 | 7/1952 | Bowen | 333/81 B |
| 2,731,603 | 1/1956 | Weber et al. | 333/81 B |
| 2,853,687 | 9/1958 | Weber | 333/81 B |
| 2,981,907 | 4/1961 | Bundy | 333/248 X |
| 3,867,707 | 2/1975 | Pering et al. | 329/132 |
| 4,050,070 | 9/1977 | Beno et al. | 342/187 |
| 4,654,610 | 3/1987 | Dasilva | 333/81 R |

FOREIGN PATENT DOCUMENTS

| | | | |
|---|---|---|---|
| 0136703 | 10/1980 | Japan | 333/81 B |

OTHER PUBLICATIONS

Harry E. Thomas, "Handbook of Microwave Techniques and Equipment" p. 147, 1972 (see FIGS. 9-7 (a)-(e).

*Primary Examiner*—Eugene R. Laroche
*Assistant Examiner*—Seung Ham
*Attorney, Agent, or Firm*—Thomas G. Berry; Steven G. Parmelee; Donald B. Southard

[57] ABSTRACT

A linear microwave attenuator has an absorbing element which is selectively shaped to provide reduced capacitive coupling and increased attenuation by segmenting the absorber into at least two members. The selective shaping reduces both the surface area and mass of the absorber while maximizing the attenuation of possible from the absorber. In this way, reduced size, linear performance, and increased attenuation over those of the prior art are provided by the present invention.

8 Claims, 3 Drawing Sheets

—PRIOR ART—

—PRIOR ART—

—PRIOR ART—

—PRIOR ART—

LINEAR MICROWAVE ATTENUATOR

TECHNICAL FIELD

This invention relates generally to attenuators and more specifically to microwave attenuators, and is more particularly directed toward a linear microwave attenuator.

BACKGROUND ART

Designers and Technicians of Microwave Radio Equipment have long employed microwave attenuators to design, test, and repair microwave radios. Typically, such microwave attenuators are incorporated into a wave guide or similar housing in order to simulate adverse transmission characteristics such as, for example, transmission path fading. Generally, microwave attenuators operate by absorbing the electromagnetic energy of a wave traveling down the wave guide. The amount of attenuation may be varied by changing the insertion depth of an absorbing element.

A substantial detriment of prior microwave attenuators comprises the non-linearity of attenuation in relation to the insertion depth of an absorbing element. The non-linearity of attenuation results from a compounding of attenuation effects due to the critical parameters of absorber surface area, mass (i.e., the bulk or volume and not necessarily the weight or specific gravity of the absorber), and capacitive coupling of the absorber to the bottom of the wave guide. In FIG. 1, a rudimentary microwave attenuator 100 comprises an absorbing element 102, which may be variably inserted into a wave guide 104. Once positioned, the absorbing element 102 is fixed by a locking screw 106. As the absorber 102 is lowered into the wave guide, the inserted surface area and mass increase thereby increasing the amount of attenuation. Additionally, the capacitive coupling between the bottom edge of the absorber 102 and the bottom of the wave guide increases, which causes non-linear changes in the amount of attenuation. Therefore, small variations of the insertion depth of the absorber can result in widely varying attenuation rates of the traveling wave.

In FIG. 2, another non-linear attenuator 200 fully incorporates absorbing strips 202 within the Wave guide 206. This is possible since there is no electric field energy at the side walls of the wave guide. To vary the attenuation, an adjustment screw 204 is rotated thereby causing the absorbing strips to arch toward the center of the wave guide. As the absorbers 202 move toward the center of the wave guide 206, more of the electromagnetic energy is incident upon the absorbers 202 and the surface area and mass are gradually able to absorb this energy. This provides non-linear operation since the penetration into the center of the wave guide 206 increases the surface area and mass of the absorbers non-linearly. The capacitive coupling between the bottom edge portion of the absorbers and the bottom of the wave guide is maintained relatively constant since the absorber is always in the wave guide.

In FIG. 3*a*, yet another non-linear attenuator 300 is shown. The absorber 302 is rotated into a slot 304 in the wave guide 306 by rotating a knob 308. The amount of attenuation is measured by a calibrated dial 310, after which the absorber 302 is locked into position with a locking screw 312. The attenuator 300 operates non-linearly since the arcual shaped absorber 302 increases the surface area an mass non-linearly when the penetration depth of the absorber 302 within the wave guide 306 is increased. The primary advantage is that the capacitive effects are minimized for the fully inserted absorber. However, the attenuator 300 still provides non-linearly varying attenuation due to the mass and surface area effects as the absorber 302 is lowered into the wave guide 306. Typically, the calibration dial 310 is not a linear scale, but graduated in an attempt to incorporate these parameters.

The non-linear attenuator 300 of FIG. 3*a* may be linearized if the absorber shape is changed to that illustrated in FIG. 3*b*. The shape of the absorber 302' has been varied from a conventional arch to cause a shift in its point of rotation into the wave guide. However, even with this improvement, the attenuators of FIGS. 2 and 3*a* are expensive and bulky. Typically, these attenuators must exceeds a length of 18 inches to provide an attenuation rate on the order of 60 db. Smaller versions of these attenuators typically obtain attenuation rates not greater than 30 db. Therefore, a need exists in the art to provide a small inexpensive linear microwave attenuator that has the capability of providing improved attenuation rates over that of the prior art.

SUMMARY OF THE INVENTION

It is therefore an object of the present invention to provide an improved linear microwave attenuator.

It is another object of the present invention to provide a linear microwave attenuator that provides increased attenuation while removing both surface area and mass of the absorber.

It is a further object of the present invention to provide a flattened or uniform attenuation across a band of microwave frequencies.

These and other objects are achieved in the linear microwave attenuator of the present invention.

Briefly, according to the invention, an absorbing element is selectively shaped to provide reduced capacitive coupling and increased attenuation by segmenting the absorber into at least two members. The selective shaping reduces both the surface area and mass of the absorber while maximizing the attenuation possible from the absorber. In this way, reduced size and increased attenuation over those of the prior art are provided by the present invention.

BRIEF DESCRIPTION OF THE DRAWINGS

The features of the present invention which are believed to be novel are set forth with particularity in the appended claims. The invention, together with further objects and advantages thereof, may be understood by reference to the following description, taken in conjunction with the accompanying drawings, and the several figures of which like reference numerals identify like elements, and in which:

DESCRIPTION OF THE PREFERRED EMBODIMENT

Figure 4:
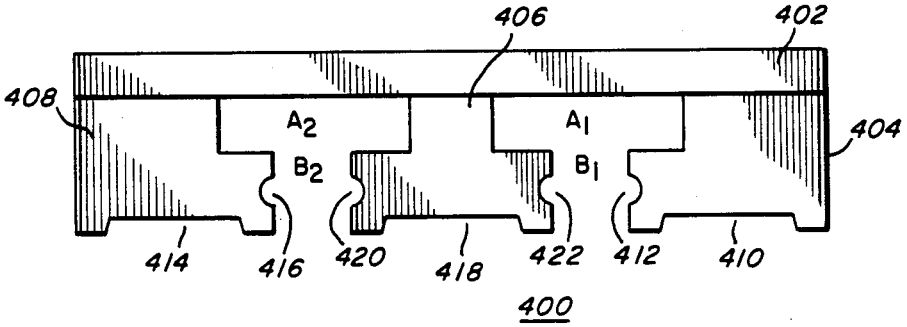
FIG. 4 is a side view of the absorber in with the present invention.

Referring now to FIG. 4, there is shown the absorber 400 in accordance with the present invention. Preferably, the absorber 400 is constructed and arranged to absorb energy (i.e., operate as a attenuator) across a band of microwave frequencies. That is, typically microwave radios operate in bands having groups or super-groups of audio channels to be broadcast. Additionally, the absorber 400 preferably provides linear attenuation uniformly across the frequency band of interest The absorber 400 consists of a supporting member 402 and attenuation members 404,,406, and 408. Element 406 is optional, but preferably is included to provide optimized attenuation across the band. According to the present invention, element 404 is specially shaped to comprise a substantially "L" shaped element having a recess 410 formed along the bottom edge of the longitudinal portion of the "L" shaped member 404. The length of the longitudinal portion is specifically selected to correspond to the electrical length of one-half (½) of the wavelength of the frequency representing the upper edge of the band of interest. This operates to more effectively couple energy into the attenuation element thereby improving attenuation performance. The recess 410 reduces the capacitive coupling between the element 404 and the bottom portion of the wave guide thereby providing more linearized attenuation. Additionally, the attenuation element 404 includes a notch portion 412 formed along the end of the longitudinal portion of element 404. The notch 412 operates to shift the peak attenuation points of the absorber 400 to provide more uniform attenuation across the frequency band of interest. Generally, the dimensions and location of both the recess 410 and the notch 412 are empirically optimized for each particular implementation.

Element 408 is essentially identical to the element 404 except that the length of its longitudinal portion is selected to be a half wave length of the lowest frequency that defines the frequency band of interest. Element 408 has a recess 414 along its bottom portion to reduce capacitive coupling, and a notch portion 416 to shift the peak attenuation points to provide more uniform attenuation across the band. Both the recess and the notch portion are empirically optimized in a particular implementation to provide a satisfactory attenuation.

To improve or further optimize the absorber of the present invention, an element 406 is preferably disposed between the elements 404 and 408. Element 406 comprises a substantially inverted "T" shape element having a recess 418 formed along the bottom portion of the longitudinal edge of the element, which has a length selected to correspond to one-half (½) the wavelength of a frequency approximately in the center of the frequency band of interest. Element 406 has notches 420 and 422 formed along its respective ends of the longitudinal portion to more uniformly distribute the attenuation of the absorber across the frequency band of interest.

The attenuation elements 404, 406 and 408 are in a fixed relationship to one another as determined by the support member 402. More specifically, the members are positioned such that restricted areas A1 and B1 are formed between members 404 and 406, and restricted areas A2 and B2 formed between members 406 and 408. Of course, if element 406 were not employed in any particular implementation elements 404 and 408 would form similar restricted areas between them. The restricted areas B1 and B2 increase the amount of attenuation over that which would be available using a solid piece of absorbing material as practiced in the prior art. The restricted areas A1 and A2 reduced the overall surface area and mass of the absorber element as it is incrementally lowered into the wave guide, thereby providing a more uniform and linear attenuation over that of the prior art. Typically, when the absorber of the present invention is optimized as in its preferred embodiment 60 dB of attenuation is achievable in an overall absorber length of 3.2 inches. This corresponds to an overall attenuator length of 5.45 inches.

Preferably, the absorber 400 is constructed of a magnetically loaded epoxy available from several commercial suppliers. Alternately, additional inverted "T" shaped elements similar to element 406 may be disposed between existing elements to further attempt to more uniformly provide attenuation across the band, and to further increase the maximum attenuation of the the attenuator. Preferably, these additional elements would have electrical length corresponding to one-half (½) of the wave length of a selected frequency within the frequency band of interest.

Figure 5:
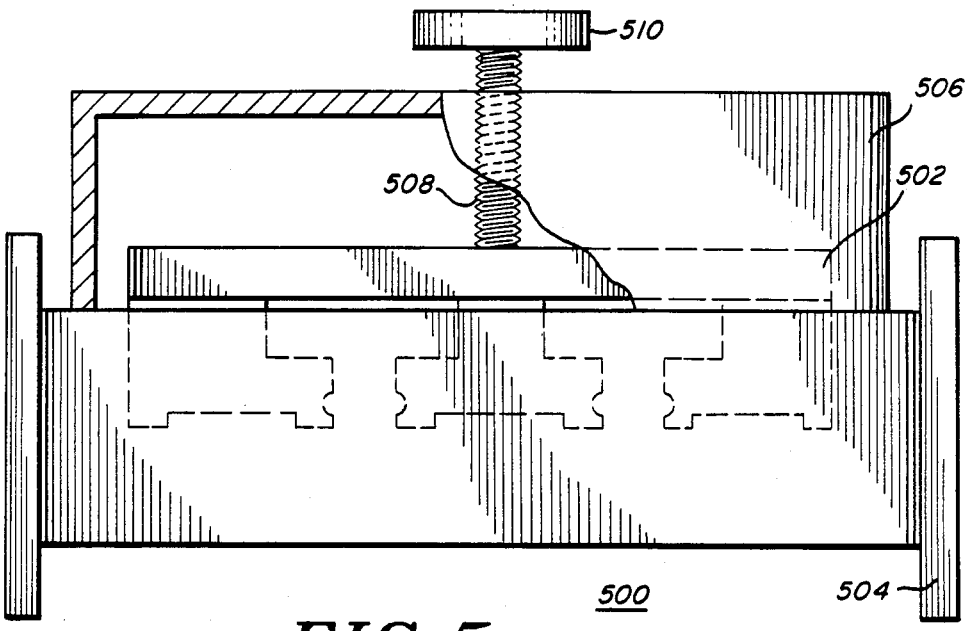
FIG. 5 is a cut away view of the linear microwave attenuator according to the present invention.
Figure 7A:
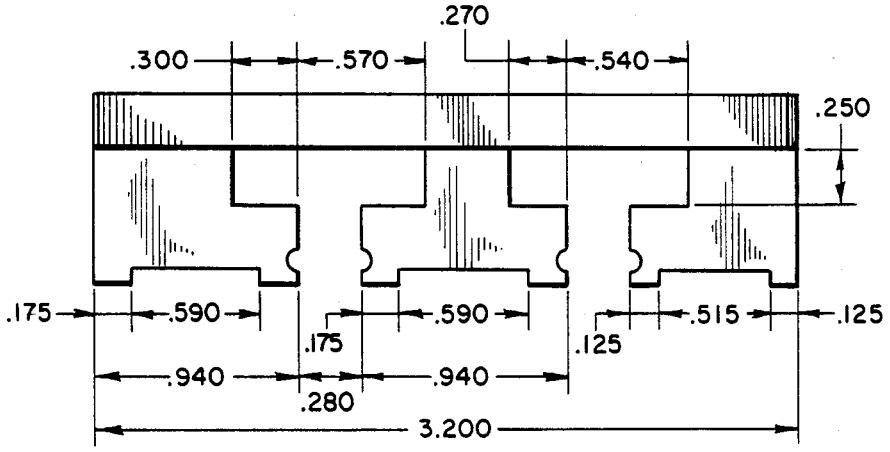
FIGS. 7*a* and 7*b* are particular examples of the present invention to cover the 7.1 to 7.8 GHz band of microwave frequencies.
Figure 7B:
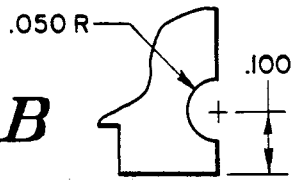

Referring now to FIG. 5, the preferred embodiment of the linear microwave attenuator 500 is shown. The attenuator 500 comprises the absorber 502, which is removably insertable into a wave guide 504. The absorber 502 resides in a housing 506 that is located on top of the wave guide 504. To insert or remove the absorber 502, a threaded shaft 508 is rotated via a knob 510 or equivalent. Optionally, the knob 510 could be remoted to another location by means of a flexible cable or the like. Alternately, the knob 510 can be replaced by a motor such as, for example, a DC step motor so that the absorber 502 could be inserted or removed by remote control of a computer, microprocessor or other controlling device.

Figure 1:
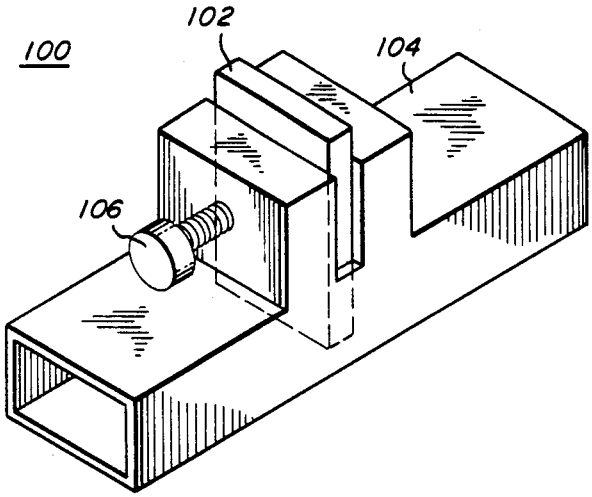
FIGS. 1–3 are illustrations of microwave attenuators in accordance with the prior art.
Figure 2:
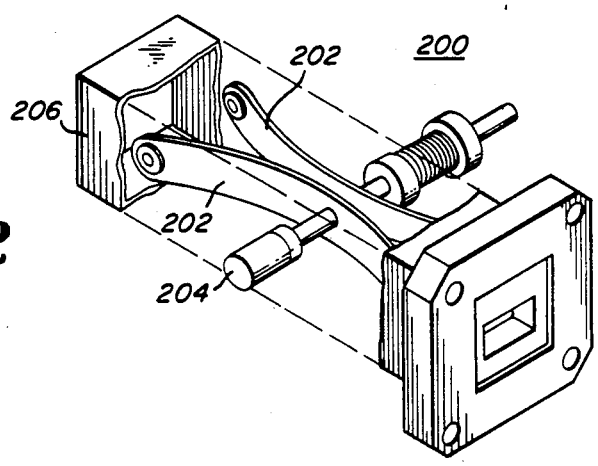
Figure 3A:
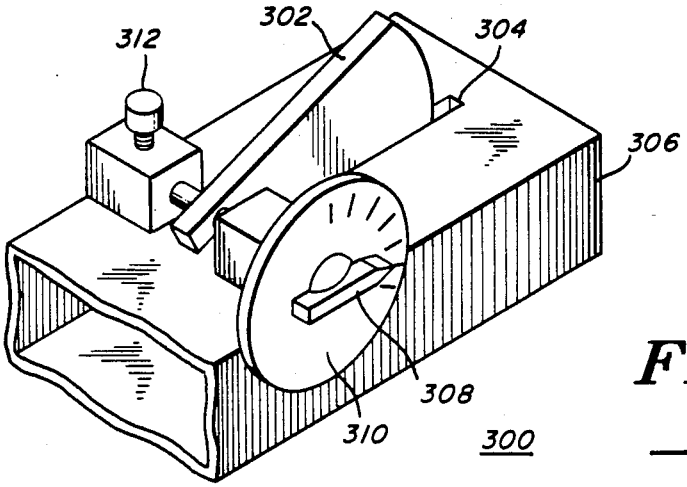
Figure 3B:
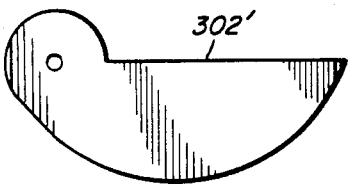
Figure 6:
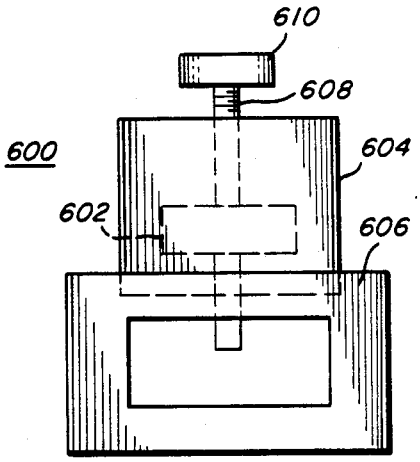
FIG. 6 is an end view of FIG. 5.

Referring now to FIG. 6, the linear microwave attenuator 600 is shown from an end view prospective. The absorber 602 can be seen inside the housing 604 and partially inserted into the wave guide 606. As previously mentioned, the absorber 602 can be further inserted or removed from the wave guide 606 by rotating the threaded shaft 608 via the knob 610 thereby attenuating a wave traveling through the wave guide 600.

Referring now to FIGS. *7a* and *7b*, a particular example of the preferred embodiment of the present invention is shown with dimensions identified for the frequency band of 7.1–7.8 GHz. In FIG. *7a* and *7b* all dimensions are in inches thus illustrating the miniaturized shape of the absorber 700 as having an overall length of 3.2 inches.

While a particular embodiment of the present invention has been described and shown, it should be understood by those of ordinary skill in the art that the present invention is not limited thereto since many modifications can be made. It is therefore contemplated to cover by the present application any and all such modifications that may fall within the true spirit and scope of the basic underlying principles disclosed and claimed herein.

What is claimed is:

1. A linear attenuator suitable for use at microwave frequencies, comprising:

a wave guide constructed and arranged to propagate electromagnetic energy associated with the microwave frequencies, and to receive an absorber;

said absorber comprising:

a support member for supporting at least a first and second attenuation member;

said first and second attenuation member each comprising a substantially "L" shaped element having a selectively shaped longitudinal bottom portion;

said first and second attenuation members being fixed by said support member to provide restricted areas between and above said selectively shaped longitudinal bottom portions of said first and second substantially "L" shaped elements;

whereby, said absorber attenuates the microwave frequencies by absorbing said associated electromagnetic energy of the microwave frequencies.

2. The microwave attenuator of claim 1, wherein the longitudinal bottom portion of said first attenuation member has a length corresponding to the electrical length of one-half wavelength of a first frequency.

3. The microwave attenuator of claim 1, wherein the longitudinal bottom portion of said second attenuation member has a length corresponding to the electrical length of one-half wavelength of a second frequency.

4. The microwave attenuator of claim 1, which includes at least a third attenuation member disposed between said first and second attenuation members comprising a substantially inverted "T" shaped element having a selectively shaped bottom longitudinal portion.

5. The microwave attenuator of claim 4, wherein the longitudinal bottom portion of said third attenuation member has a length corresponding to the electrical length of one-half wavelength of a third frequency.

6. A linear attenuator suitable for use at microwave frequencies, comprising:

a wave guide constructed and arranged to propagate electromagnetic energy associated with the microwave frequencies, and to receive an absorber;

said absorber comprising:

a support member for supporting at least a first, second, and third attenuation member;

said first and second attenuation member each comprising a substantially "L" shaped element having a selectively shaped longitudinal bottom portion;

said third attenuation member comprising a substantially inverted "T" shaped element having a selectively shaped bottom longitudinal portion said third attenuation member disposed between said first and second attenuation member, and each attenuation member being fixed by said support member to provide restricted areas between and above said selectively shaped longitudinal bottom portions of said first and second substantially "L" shaped elements and said substantially inverted "T" shaped element;

whereby, said absorber attenuates the microwave frequencies by absorbing said associated electromagnetic energy of the microwave frequencies.

7. A linear attenuator for attenuating a band of microwave frequencies defined by a lower frequency and an upper frequency, comprising:

a wave guide constructed and arranged to propagate electromagnetic energy associated with the microwave frequencies, and to receive an absorber;

said absorber comprising:

a support member for supporting at least a first, second, and third attenuation member;

said first attenuation member comprising a substantially "L" shaped element having a selectively shaped longitudinal bottom portion having a length corresponding to approximately one-half ($\frac{1}{2}$) of a wavelength at the lower frequency;

said second attenuation member comprising a substantially "L" shaped element having a selectively shaped longitudinal bottom portion having a length corresponding to approximately one-half ($\frac{1}{2}$) of a wavelength at the upper frequency;

said third attenuation member comprising a substantially inverted "T" shaped element having a selectively shaped bottom longitudinal portion having a length corresponding to approximately one-half ($\frac{1}{2}$) of a wavelength of a frequency substantially centered between the upper and lower frequencies;

said third attenuation member disposed between said first and second attenuation member, and each attenuation member being fixed by said support member to provide restricted areas between and above said selectively shaped longitudinal bottom portions of said first and second substantially "L" shaped elements and said substantially inverted "T" shaped element;

whereby, said absorber attenuates the microwave frequencies by absorbing said associated electromagnetic energy of the microwave frequencies.

8. A linear attenuator suitable for use at a microwave frequency, comprising:

a wave guide constructed and arranged to propagate electromagnetic energy associated with the microwave frequencies, and to receive an absorber;

said absorber comprising:

a support member for supporting at least a first, second, and third attenuation member;

said first and second attenuation member each comprising a substantially "L" shaped element having a selectively shaped longitudinal bottom portion having a length corresponding to approximately one-half ($\frac{1}{2}$) of a wavelength of a first frequency;

said third attenuation member comprising a substantially inverted "T" shaped element having a selectively shaped bottom longitudinal portion having a length corresponding to approximately one-half ($\frac{1}{2}$) of a wavelength of said first frequency;

said third attenuation member disposed between said first and second attenuation member, and each attenuation member being fixed by said support member to provide restricted areas between and above said selectively shaped longitudinal bottom portions of said first and second substantially "L" shaped elements and said substantially inverted "L" shaped element;

whereby, said absorber attenuates the microwave frequencies by absorbing said associated electromagnetic energy of the microwave frequencies.

* * * * *